US010517364B2

(12) United States Patent
Ragans

(10) Patent No.: US 10,517,364 B2
(45) Date of Patent: Dec. 31, 2019

(54) LIGHTED HANDBAG ASSEMBLY

(71) Applicant: Duane Ragans, Yorktown, VA (US)

(72) Inventor: Duane Ragans, Yorktown, VA (US)

( * ) Notice: Subject to any disclaimer, the term of this patent is extended or adjusted under 35 U.S.C. 154(b) by 0 days.

(21) Appl. No.: 15/976,479

(22) Filed: May 10, 2018

(65) Prior Publication Data

US 2019/0343257 A1 Nov. 14, 2019

(51) Int. Cl.

| | |
|---|---|
| ***A45C 15/06*** | (2006.01) |
| ***A45C 3/06*** | (2006.01) |
| ***A45C 13/24*** | (2006.01) |
| ***F21V 23/04*** | (2006.01) |
| ***H01H 36/00*** | (2006.01) |
| ***F21S 9/02*** | (2006.01) |
| ***F21Y 115/10*** | (2016.01) |
| ***F21Y 105/10*** | (2016.01) |

(52) U.S. Cl.

CPC ..... *A45C 15/06* (2013.01); *A45C 3/06* (2013.01); *A45C 13/24* (2013.01); *F21V 23/04* (2013.01); *F21S 9/02* (2013.01); *F21Y 2105/10* (2016.08); *F21Y 2115/10* (2016.08); *H01H 36/0006* (2013.01)

(58) Field of Classification Search

CPC ..... A45C 15/06; A45C 3/06; A45C 13/24; F21V 23/04

USPC ..... 362/103

See application file for complete search history.

(56) References Cited

U.S. PATENT DOCUMENTS

| | | | | | |
|---|---|---|---|---|---|
| 3,609,342 | A * | 9/1971 | Wisniewski | A45C 15/06 | 362/100 |
| 3,696,359 | A * | 10/1972 | Ross | G08B 13/08 | 335/205 |
| 3,701,140 | A * | 10/1972 | Dixon | A45C 13/24 | 200/61.85 |
| 3,800,134 | A * | 3/1974 | Castaldo | A45C 15/06 | 362/155 |
| 4,118,692 | A * | 10/1978 | Fitchett | A45C 13/24 | 109/43 |
| 4,742,438 | A | 5/1988 | King | | |
| 4,954,934 | A | 9/1990 | Kidder et al. | | |
| 5,018,057 | A | 5/1991 | Biggs | | |
| 5,073,844 | A * | 12/1991 | Coyner | A45C 15/06 | 362/156 |
| 5,424,926 | A | 6/1995 | Myers | | |
| 6,447,142 | B1 * | 9/2002 | Weir | A45C 15/06 | 150/100 |
| 6,499,857 | B1 * | 12/2002 | Lumley | A43B 1/0036 | 362/103 |
| 6,508,568 | B1 | 1/2003 | Blue-Recio | | |
| 6,637,909 | B1 * | 10/2003 | Bryan | A45C 15/00 | 362/154 |
| 9,568,182 | B2 | 2/2017 | Juarez | | |
| 2004/0012495 | A1 * | 1/2004 | Hammond | A45C 13/24 | 340/568.7 |
| 2010/0053941 | A1 * | 3/2010 | Ibison | A45C 13/24 | 362/155 |
| 2012/0042996 | A1 * | 2/2012 | Glynn | A45C 15/00 | 150/106 |

(Continued)

*Primary Examiner* — Bryon T Gyllstrom

(57) ABSTRACT

A lighted handbag assembly for facilitating locating of items in the handbag includes a shell that defines an interior space. The shell has a top that is open. A power module is coupled to the shell and is positioned in the interior space. A light is coupled to the shell. The light is positioned to selectively illuminate the interior space.

18 Claims, 5 Drawing Sheets

(56) References Cited

U.S. PATENT DOCUMENTS

| | | | | |
|---|---|---|---|---|
| 2015/0022099 | A1 | 1/2015 | Farley | |
| 2016/0157575 | A1* | 6/2016 | Britten | A45C 1/02<br>362/156 |

* cited by examiner

LIGHTED HANDBAG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to handbag assemblies and more particularly pertains to a new handbag assembly for facilitating locating of items in the handbag.

BRIEF SUMMARY OF THE INVENTION

An embodiment of the disclosure meets the needs presented above by generally comprising a shell that defines an interior space. The shell has a top that is open. A power module is coupled to the shell and is positioned in the interior space. A light is coupled to the shell. The light is positioned to selectively illuminate the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
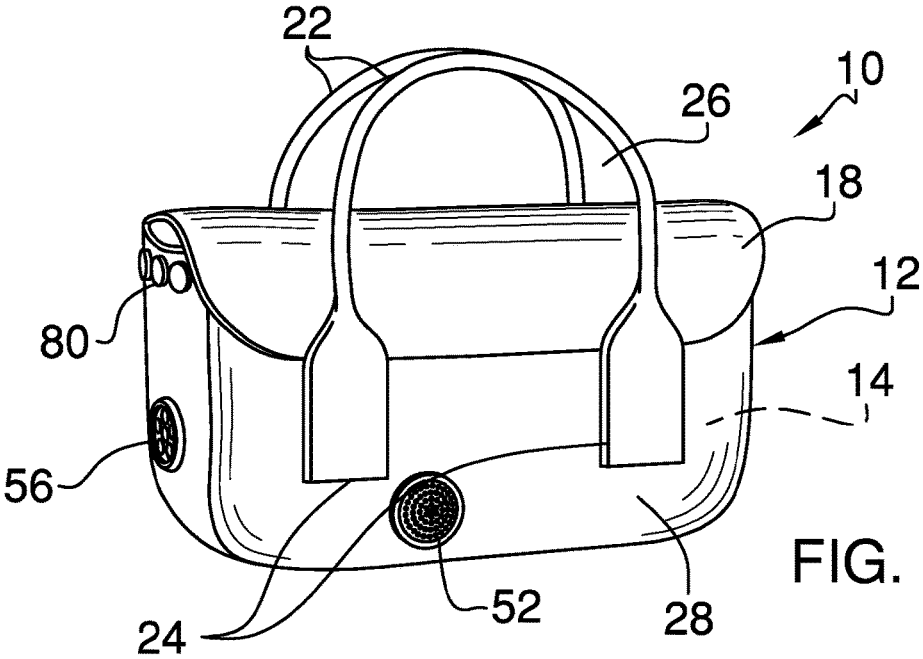
FIG. 1 is a side view of a lighted handbag assembly according to an embodiment of the disclosure.

With reference now to the drawings, and in particular to FIGS. 1 through 9 thereof, a new handbag assembly embodying the principles and concepts of an embodiment of the disclosure and generally designated by the reference numeral 10 will be described.

As best illustrated in FIGS. 1 through 9, the lighted handbag assembly 10 generally comprises a shell 12 that defines an interior space 14. The shell 12 has a top 16 that is open. A flap 18 is hingedly coupled to a first side 20 of the shell 12 proximate to the top 16. The flap 18 is positioned to selectively close the top 16.

The assembly 10 comprises a plurality of straps 22. Each strap 22 has opposing termini 24. Each opposing terminus 24 is coupled to the shell 12 to define a loop 26. The loop 26 is configured to insert an arm of the user to couple the shell 12 to the user. The plurality of straps 22 comprises two straps 22 that are coupled singly to the first side 20 and a second side 28 of the shell 12, as shown in FIG. 1.

A power module 30 is coupled to the shell 12 and is positioned in the interior space 14. The power module 30 comprises a battery 32. A light 34 is coupled to the shell 12 and is operationally coupled to the power module 30. The light 34 is positioned to selectively illuminate the interior space 14.

Figure 2:
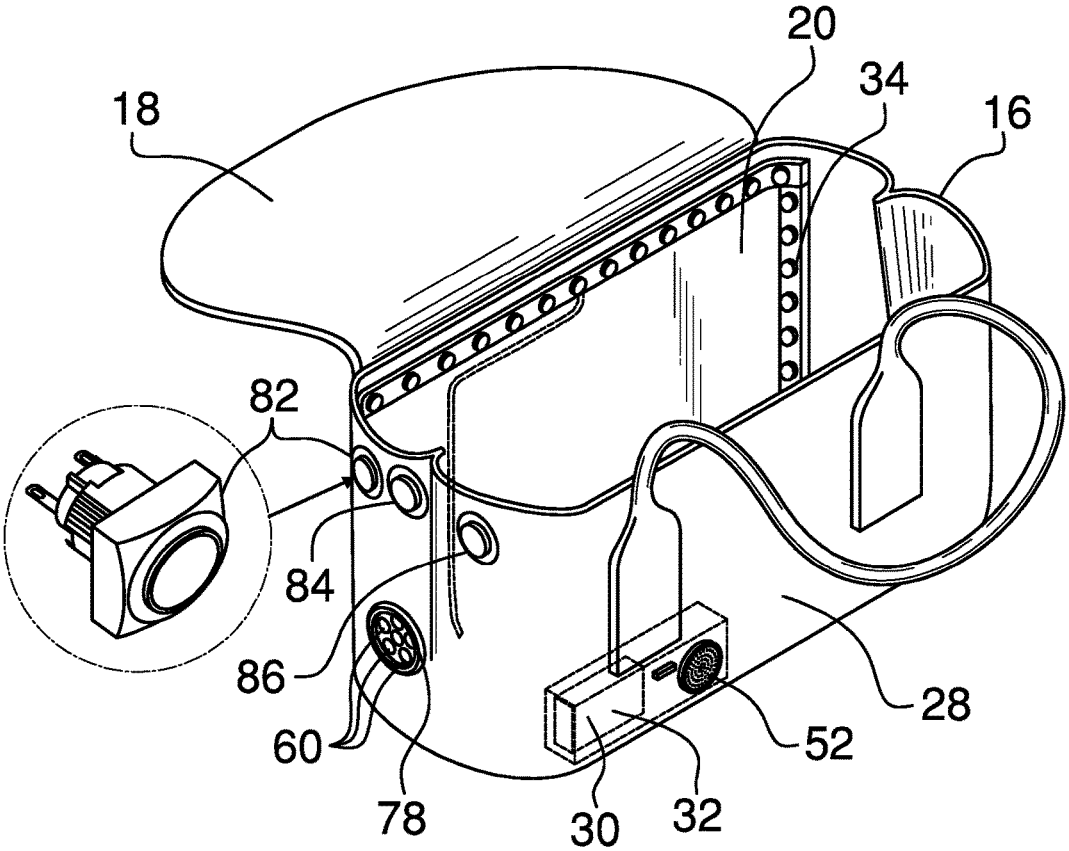
FIG. 2 is an isometric perspective view of an embodiment of the disclosure.

The light 34 is positioned in the interior space 14, as shown in FIG. 2. The light 34 comprises a string of light emitting diodes 36. The string of light emitting diodes 36 has a first section 38 and a pair of second sections 40. The first section 38 is positioned proximate to the top 16 of the shell 12 and extends between opposing ends 42 of the shell 12. Each second section 40 extends from the first section 38 along a respective opposing end 42 of the shell 12 to proximate to a bottom 44 of the shell 12. In one embodiment of the invention, as shown in FIG. 5, the light 34 comprises a fiber optic cable 46.

Figure 5:
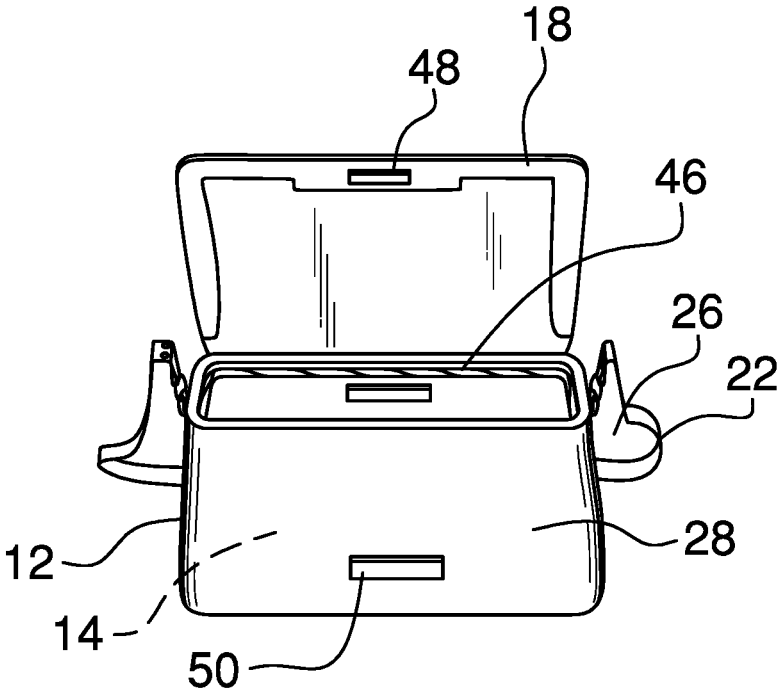
FIG. 5 is a side view of an embodiment of the disclosure.
Figure 6:
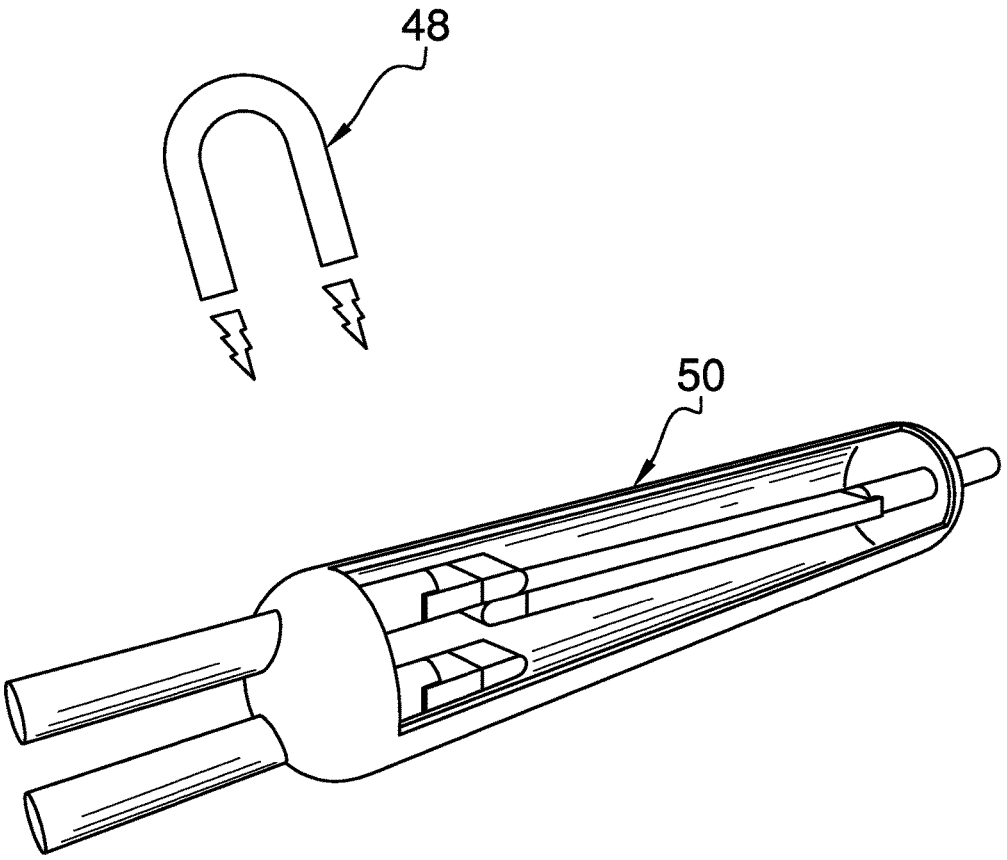
FIG. 6 is an isometric perspective view of an embodiment of the disclosure.
Figure 7:
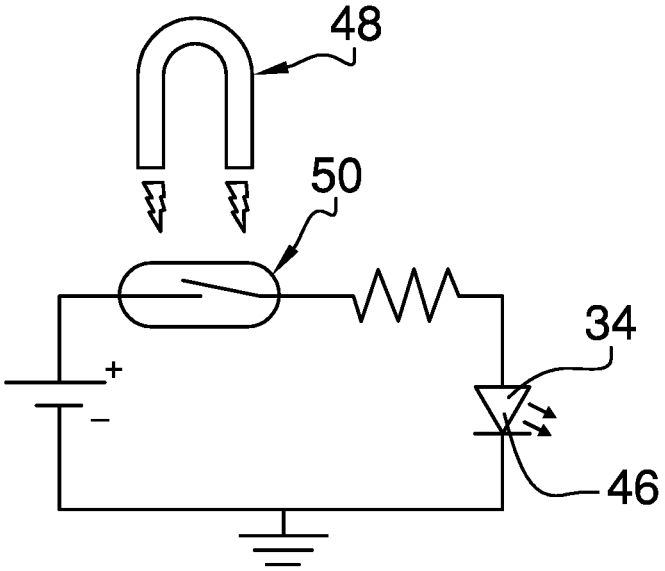
FIG. 7 is a circuit diagram of an embodiment of the disclosure.

In another embodiment of the invention, a magnet 48 is coupled to the flap 18 distal from the shell 12, as shown in FIG. 5. A switch 50 is coupled to the shell 12. The switch 50 is double-throw reed-type. The switch 50 is operationally coupled to the power module 30 and the light 34. The magnet 48 is positioned to selectively magnetically couple to the switch 50 to decouple the switch 50 from the power module 30 and to close the top 16 of the shell 12. Decoupling of the magnet 48 from the switch 50 to open the top 16 couples the switch 50 to the power module 30 to power the light 34 to illuminate the interior space 14.

Figure 3:
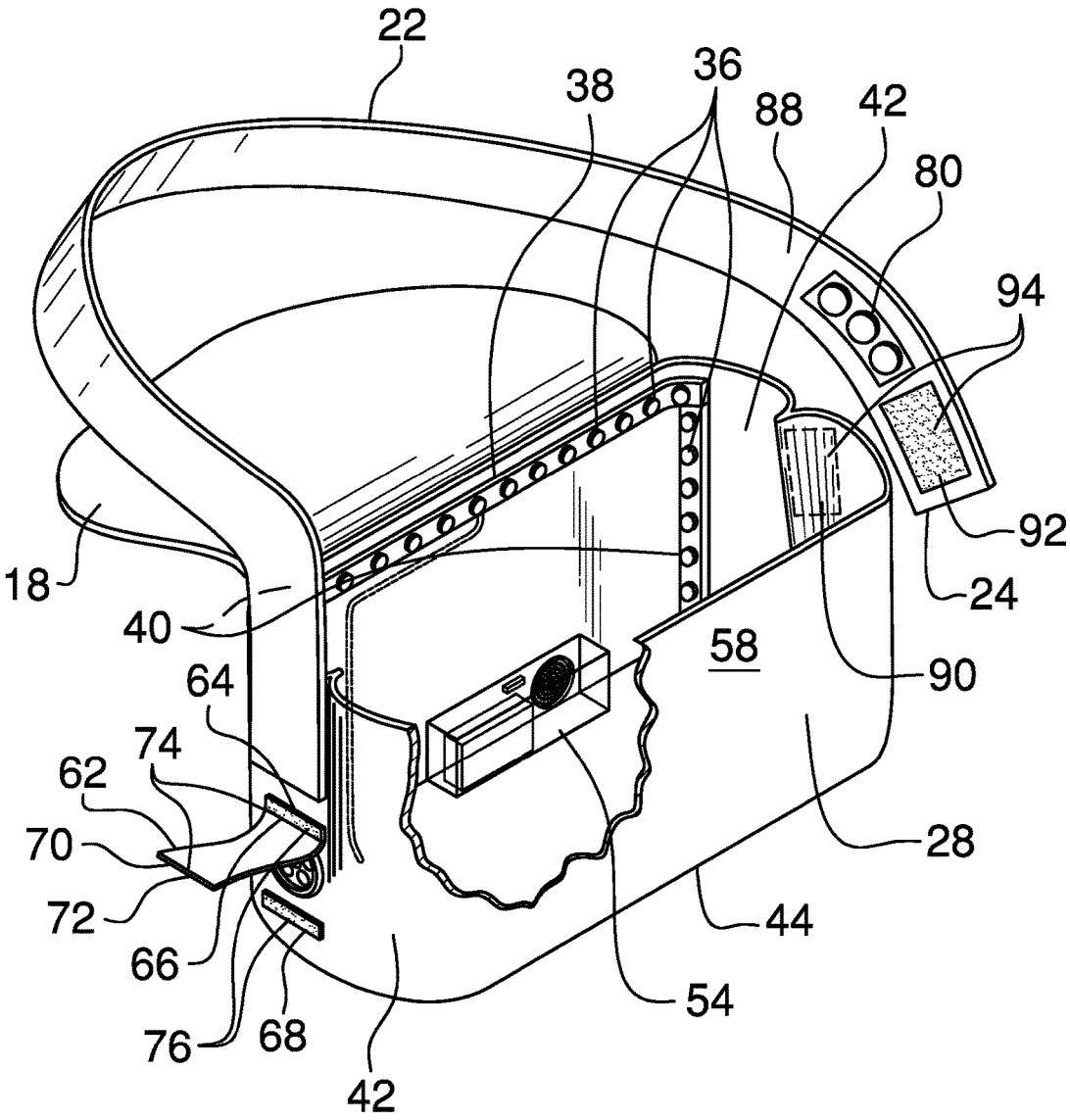
FIG. 3 is an isometric perspective view of an embodiment of the disclosure.
Figure 4:
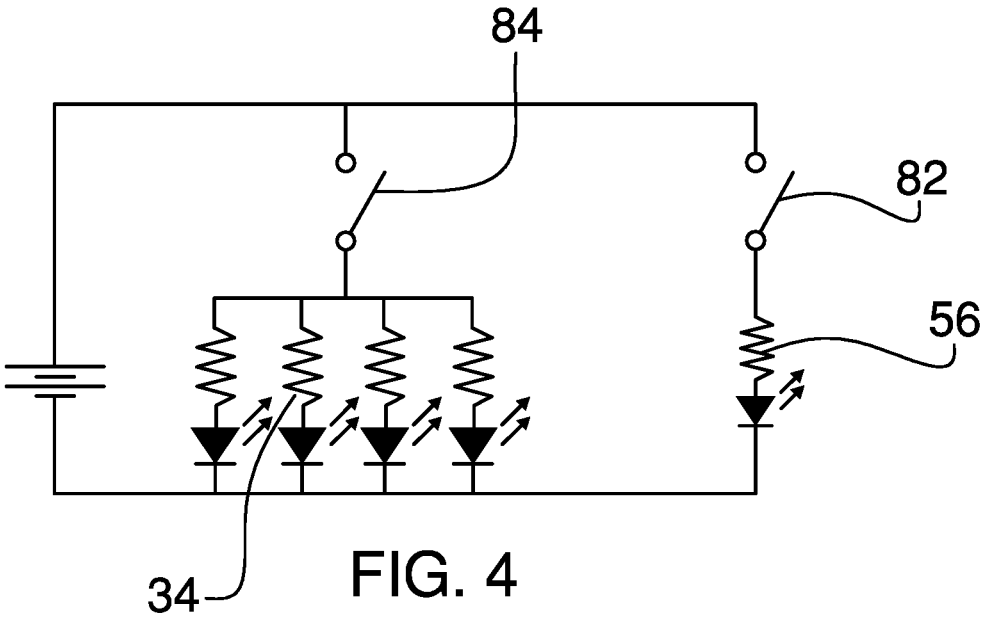
FIG. 4 is a circuit diagram of an embodiment of the disclosure.

An alarm 52 is coupled to the shell 12, as shown in FIGS. 2 and 3. The alarm 52 is operationally coupled to the power module 30. The alarm 52 is configured to selectively sound an alert. The alarm 52 is operationally coupled to a respective opposing terminus 24 of an associated strap 22. Separation of the respective opposing terminus 24 from the shell 12, such as would occur in a purse snatching, actuates the alarm 52.

A housing 54 is coupled to the second side 28 of the shell 12 and is positioned in the interior space 14 proximate to the bottom 44 of the shell 12, as shown in FIG. 2. The power module 30 is positioned in the housing 54. The alarm 52 is coupled to the housing 54 and protrudes from the second side 28 of the shell 12.

A bulb 56 is coupled to an exterior 58 of the shell 12, as shown in FIG. 1. The bulb 56 is operationally coupled to the power module 30. The bulb 56 is configured to selectively illuminate a space proximate to the shell 12. The bulb 56 is positioned on a respective opposing end 42 of the shell 12. The bulb 56 comprises a plurality of light emitting diodes 60.

A panel 62 is coupled by a first edge 64 to the shell 12 above the bulb 56, as shown in FIG. 3. The panel 62 is flexible. The panel 62 covers the bulb 56. A first connector 66 is coupled to the panel 62 proximate to the first edge 64. A second connector 68 is coupled to the panel 62 below the bulb 56. A third connector 70 is coupled to the panel 62 proximate to a second edge 72 of the panel 62. The third connector 70 is complementary to the first connector 66 and the second connector 68. The third connector 70 is positioned to couple to the second connector 68 to fixedly position the panel 62 over the bulb 56. The third connector 70 is positioned to couple to the first connector 66 to expose the bulb 56. The third connector 70 and the first connector 66 comprise a first panel hook and loop fastener 74. The third connector 70 and the second connector 68 comprise a second panel hook and loop fastener 76.

A sensor 78 is coupled to the shell 12 adjacent to the bulb 56. The sensor 78 is operationally coupled to the bulb 56 and the power module 30. The sensor 78 is proximity type. The sensor 78 is positioned to detect removal of the panel 62 that covers the bulb 56. The sensor 78 is positioned to couple the bulb 56 to the power module 30 to illuminate the space proximate to the shell 12.

A controller 80 is coupled to the shell 12. The controller 80 is operationally coupled to the power module 30 and the light 34. The controller 80 is positioned to selectively couple the light 34 to the power module 30 to illuminate the interior space 14. The controller 80 is positioned on the respective opposing end 42 of the shell 12.

The controller 80 comprises a first button 82, a second button 84, and a third button 86. The first button 82, the second button 84, and the third button 86 are depressible. The first button 82 is operationally coupled to the bulb 56 and the power module 30. The first button 82 is configured to be depressed to couple the bulb 56 to the power module 30 to illuminate the space proximate to the shell 12. The second button 84 is operationally coupled to the light 34 and the power module 30. The second button 84 is configured to be depressed to couple the light 34 to the power module 30 to illuminate the interior space 14. The third button 86 is operationally coupled to the alarm 52 and the power module 30. The third button 86 is configured to be depressed to couple the alarm 52 to the power module 30 to sound the alert.

In yet another embodiment of the invention, as shown in FIG. 3, the housing 54 is coupled to the first side 20 of the shell 12. The alarm 52 is coupled to the housing 54 and protrudes from the first side 20 of the shell 12. The plurality of straps 22 in this embodiment comprises one strap 22. The controller 80 is coupled to an underside 88 of the strap 22. Each of a pair of first couplers 90 is coupled singly to the opposing ends 42 of the shell 12 proximate to the top 16. Each of a pair of second couplers 92 is coupled to the underside 88 of the strap 22. The second couplers 92 are positioned singly proximate to the opposing termini 24 of the strap 22. The second couplers 92 are complementary to the first couplers 90. Each second coupler 92 is positioned to couple to a respective first coupler 90 to couple the strap 22 to the shell 12. The second coupler 92 and the respective first coupler 90 comprise a strap hook and loop fastener 94.

Figure 8:
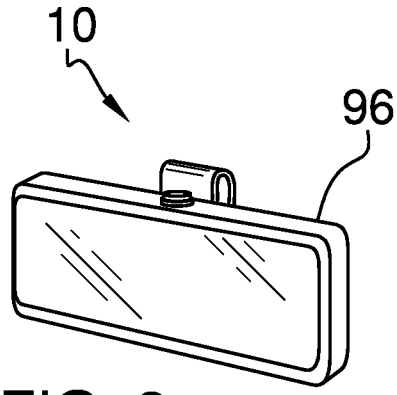
FIG. 8 is a front view of an embodiment of the disclosure.
Figure 9:
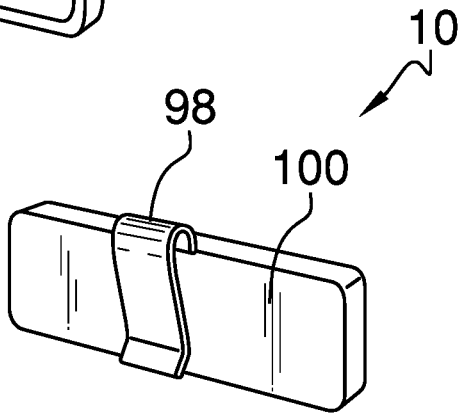
FIG. 9 is a back view of an embodiment of the disclosure.

In still yet another embodiment of the invention, as shown in FIGS. 8 and 9, the assembly 10 comprises an illuminator 96. The shell 12 in this embodiment comprises a purse of the user. The illuminator 96 is light emitting diode type. A clip 98 is coupled to a back 100 of the illuminator 96 and is configured to selectively couple the illuminator 96 to the purse of the user. The illuminator 96 is positioned to decouple from the purse to position the user to illuminate a target. In this embodiment, the housing 54, the controller 80, the bulb 56, and the light 34 are reversibly couplable to the purse.

In use, the first button 82 may be depressed to couple the bulb 56 to the power module 30 to illuminate the space proximate to the shell 12. The sensor 78 is positioned to detect removal of the panel 62 that covers the bulb 56 and to couple the bulb 56 to the power module 30 to illuminate the space proximate to the shell 12. The second button 84 may be depressed to couple the light 34 to the power module 30 to illuminate the interior space 14. Decoupling of the magnet 48 from the switch 50 to open the top 16 couples the switch 50 to the power module 30 to power the light 34 to illuminate the interior space 14. The third button 86 may be depressed to couple the alarm 52 to the power module 30 to sound the alert. Separation of the respective opposing terminus 24 from the shell 12, such as would occur in a purse snatching, also actuates the alarm 52 to sound the alert.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lighted handbag assembly comprising:

a shell defining an interior space, said shell having a top, said top being open;

a power module coupled to said shell and positioned in said interior space;

a light coupled to said shell, said light being operationally coupled to said power module wherein said light is positioned for selectively illuminating said interior space, a panel coupled by a first edge to said shell above said bulb, said panel being flexible such that said panel covers said bulb;

a first connector coupled to said panel proximate to said first edge;

a second connector coupled to said panel below said bulb;

a third connector coupled to said panel proximate to a second edge of said panel, said third connector being complementary to said first connector and said second connector, wherein said third connector is positioned for coupling to said second connector for fixedly positioning said panel over said bulb, wherein said third connector is positioned for coupling to said first connector for exposing said bulb, said third connector and said first connector comprising a first panel hook and loop fastener, said third connector and said second connector comprising a second panel hook and loop fastener; and a sensor coupled to said shell adjacent to said bulb, said sensor being operationally coupled to said bulb and said power module, said sensor being proximity type such that said sensor is positioned for detecting removal of said panel covering said bulb wherein said sensor is positioned for coupling said bulb to said power module for illuminating the space proximate to said shell.

2. The assembly of claim 1, further comprising:

a flap hingedly coupled to a first side of said shell proximate to said top wherein said flap is positioned for selectively closing said top; and a plurality of straps, each said strap having opposing termini, each said opposing terminus being coupled to said shell defining a loop wherein said loop is configured for inserting an arm of the user for coupling said shell to the user, said plurality of straps comprising two said straps coupled singly to said first side and a second side of said shell.

3. The assembly of claim 2, further including an alarm coupled to said shell, said alarm being operationally coupled to said power module wherein said alarm is configured for selectively sounding an alert.

4. The assembly of claim 3, further including said alarm being operationally coupled to a respective said opposing terminus of an associated said strap wherein separation of said respective said opposing terminus from said shell actuates said alarm.

5. The assembly of claim 3, further including a housing coupled to said second side of said shell and positioned in said interior space proximate to said bottom of said shell, said power module being positioned in said housing, said alarm being coupled to said housing and protruding from said second side of said shell.

6. The assembly of claim 5, further including a bulb coupled to an exterior of said shell, said bulb being operationally coupled to said power module wherein said bulb is configured for selectively illuminating a space proximate to said shell, said bulb being positioned on a respective said opposing end of said shell, said bulb comprising a plurality of light emitting diodes.

7. The assembly of claim 6, further including a controller coupled to said shell, said controller being operationally coupled to said power module and said light wherein said controller is positioned for selectively coupling said light to said power module for illuminating said interior space, said controller being positioned on said respective said opposing end of said shell.

8. The assembly of claim 7, further comprising:

said shell comprising a purse of the user;

an illuminator, said illuminator being light emitting diode type;

a clip coupled to a back of said illuminator wherein said clip is configured for selectively coupling said illuminator to a purse of the user such that said illuminator is positioned for decoupling from the purse positioning the user for illuminating a target; and said housing, said controller, said bulb, and said light being reversibly couplable to the purse.

9. The assembly of claim 7, further comprising:

said housing being coupled to said first side of said shell, said alarm being coupled to said housing and protruding from said first side of said shell;

said plurality of straps comprising one said strap, said controller being coupled to an underside of said strap;

a pair of first couplers coupled singly to opposing ends of said shell proximate to said top; and a pair of second couplers coupled to said underside of said strap, said second couplers being positioned singly proximate to said opposing termini of said strap, said second couplers being complementary to said first couplers wherein each said second coupler is positioned for coupling to a respective said first coupler for coupling said strap to said shell, said second coupler and said respective said first coupler comprising a strap hook and loop fastener.

10. The assembly of claim 1, further including said power module comprising a battery.

11. The assembly of claim 1, further including said light being positioned in said interior space, said light comprising a string of light emitting diodes, said string of light emitting diodes having a first section and a pair of second sections, said first section being positioned proximate to said top of said shell and extending between said opposing ends of said shell, each said second section extending from said first section along a respective said opposing end of said shell to proximate to a bottom of said shell.

12. The assembly of claim 1, further comprising:

a magnet coupled to said flap distal from said shell; and a switch coupled to said shell, said switch being double-throw reed-type, said switch being operationally coupled to said power module and said light wherein said magnet is positioned for selectively magnetically coupling to said switch for decoupling said switch from said power module and for closing said top of said shell such that decoupling of said magnet from said switch for opening said top couples said switch to said power module for powering said light for illuminating said interior space.

13. The assembly of claim 1, further including said light comprising a fiber optic cable.

14. A lighted handbag assembly comprising:

a shell defining an interior space, said shell having a top, said top being open;

a power module coupled to said shell and positioned in said interior space;

a light coupled to said shell, said light being operationally coupled to said power module wherein said light is positioned for selectively illuminating said interior space;

a flap hingedly coupled to a first side of said shell proximate to said top wherein said flap is positioned for selectively closing said top;

a plurality of straps, each said strap having opposing termini, each said opposing terminus being coupled to said shell defining a loop wherein said loop is configured for inserting an arm of the user for coupling said shell to the user, said plurality of straps comprising two said straps coupled singly to said first side and a second side of said shell;

an alarm coupled to said shell, said alarm being operationally coupled to said power module wherein said alarm is configured for selectively sounding an alert;

a housing coupled to said second side of said shell and positioned in said interior space proximate to said bottom of said shell, said power module being positioned in said housing, said alarm being coupled to said housing and protruding from said second side of said shell;

a bulb coupled to an exterior of said shell, said bulb being operationally coupled to said power module wherein said bulb is configured for selectively illuminating a space proximate to said shell, said bulb being positioned on a respective said opposing end of said shell, said bulb comprising a plurality of light emitting diodes;

a controller coupled to said shell, said controller being operationally coupled to said power module and said light wherein said controller is positioned for selectively coupling said light to said power module for illuminating said interior space, said controller being positioned on said respective said opposing end of said shell;

a first button, said first button being depressible, said first button being operationally coupled to said bulb and said power module wherein said first button is configured for depressing for coupling said bulb to said power module for illuminating the space proximate to said shell;

a second button, said second button being depressible, said second button being operationally coupled to said light and said power module wherein said second button is configured for depressing for coupling said light to said power module for illuminating said interior space; and a third button, said third button being depressible, said third button being operationally coupled to said alarm and said power module wherein said third button is configured for depressing for coupling said alarm to said power module for sounding the alert.

15. A lighted handbag assembly comprising:

a shell defining an interior space, said shell having a top, said top being open;

a flap hingedly coupled to a first side of said shell proximate to said top wherein said flap is positioned for selectively closing said top;

a plurality of straps, each said strap having opposing termini, each said opposing terminus being coupled to said shell defining a loop wherein said loop is configured for inserting an arm of the user for coupling said shell to the user, said plurality of straps comprising two said straps coupled singly to said first side and a second side of said shell;

a power module coupled to said shell and positioned in said interior space, said power module comprising a battery;

a light coupled to said shell, said light being operationally coupled to said power module wherein said light is positioned for selectively illuminating said interior space, said light being positioned in said interior space, said light comprising a string of light emitting diodes, said string of light emitting diodes having a first section and a pair of second sections, said first section being positioned proximate to said top of said shell and extending between said opposing ends of said shell, each said second section extending from said first section along a respective said opposing end of said shell to proximate to a bottom of said shell;

a magnet coupled to said flap distal from said shell;

a switch coupled to said shell, said switch being double-throw reed-type, said switch being operationally coupled to said power module and said light wherein said magnet is positioned for selectively magnetically coupling to said switch for decoupling said switch from said power module and for closing said top of said shell such that decoupling of said magnet from said switch for opening said top couples said switch to said power module for powering said light for illuminating said interior space;

an alarm coupled to said shell, said alarm being operationally coupled to said power module wherein said alarm is configured for selectively sounding an alert, said alarm being operationally coupled to a respective said opposing terminus of an associated said strap wherein separation of said respective said opposing terminus from said shell actuates said alarm;

a housing coupled to said second side of said shell and positioned in said interior space proximate to said bottom of said shell, said power module being positioned in said housing, said alarm being coupled to said housing and protruding from said second side of said shell;

a bulb coupled to an exterior of said shell, said bulb being operationally coupled to said power module wherein said bulb is configured for selectively illuminating a space proximate to said shell, said bulb being positioned on a respective said opposing end of said shell, said bulb comprising a plurality of light emitting diodes;

a panel coupled by a first edge to said shell above said bulb, said panel being flexible such that said panel covers said bulb;

a first connector coupled to said panel proximate to said first edge;

a second connector coupled to said panel below said bulb;

a third connector coupled to said panel proximate to a second edge of said panel, said third connector being complementary to said first connector and said second connector, wherein said third connector is positioned for coupling to said second connector for fixedly positioning said panel over said bulb, wherein said third connector is positioned for coupling to said first connector for exposing said bulb, said third connector and said first connector comprising a first panel hook and loop fastener, said third connector and said second connector comprising a second panel hook and loop fastener;

a sensor coupled to said shell adjacent to said bulb, said sensor being operationally coupled to said bulb and said power module, said sensor being proximity type such that said sensor is positioned for detecting removal of said panel covering said bulb wherein said sensor is positioned for coupling said bulb to said power module for illuminating the space proximate to said shell; and a controller coupled to said shell, said controller being operationally coupled to said power module and said light wherein said controller is positioned for selectively coupling said light to said power module for illuminating said interior space, said controller being positioned on said respective said opposing end of said shell, said controller comprising:

a first button, said first button being depressible, said first button being operationally coupled to said bulb and said power module wherein said first button is configured for depressing for coupling said bulb to said power module for illuminating the space proximate to said shell, a second button, said second button being depressible, said second button being operationally coupled to said light and said power module wherein said second button is configured for depressing for coupling said light to said power module for illuminating said interior space, and a third button, said third button being depressible, said third button being operationally coupled to said alarm and said power module wherein said third button is configured for depressing for coupling said alarm to said power module for sounding the alert.

16. The assembly of claim 15, further comprising:

said shell comprising a purse of the user;

an illuminator, said illuminator being light emitting diode type;

a clip coupled to a back of said illuminator wherein said clip is configured for selectively coupling said illuminator to a purse of the user such that said illuminator is positioned for decoupling from the purse positioning the user for illuminating a target; and said housing, said controller, said bulb, and said light being reversibly couplable to the purse.

17. The assembly of claim 15, further including said light comprising a fiber optic cable.

18. The assembly of claim 15, further comprising said housing being coupled to said first side of said shell, said alarm being coupled to said housing and protruding from said first side of said shell;

said plurality of straps comprising one said strap, said controller being coupled to an underside of said strap;

a pair of first couplers coupled singly to opposing ends of said shell proximate to said top; and a pair of second couplers coupled to said underside of said strap, said second couplers being positioned singly proximate to said opposing termini of said strap, said second couplers being complementary to said first couplers wherein each said second coupler is positioned for coupling to a respective said first coupler for coupling said strap to said shell, said second coupler and said respective said first coupler comprising a strap hook and loop fastener.

* * * * *